US005499567A

United States Patent [19]

Gay

[11] Patent Number: 5,499,567

[45] Date of Patent: Mar. 19, 1996

[54] DISTILLATE FUEL OIL/AIR-FIRED, RAPID-FIRE CANNON

[76] Inventor: Jordan L. Gay, Sarasota, Fla.

[21] Appl. No.: 393,559

[22] Filed: Feb. 23, 1995

Related U.S. Application Data

[62] Division of Ser. No. 210,263, Mar. 18, 1994, Pat. No. 5,398,591, which is a continuation of Ser. No. 6,924, Jan. 22, 1993, abandoned.

[51] Int. Cl.[6] ..... F41A 1/04

[52] U.S. Cl. ..... 89/7

[58] Field of Search ..... 89/7

[56] References Cited

U.S. PATENT DOCUMENTS

| | | | |
|---|---|---|---|
| 2,391,636 | 12/1945 | McArthur | 89/7 |
| 3,380,345 | 4/1968 | Nelson | 89/7 |
| 4,100,836 | 7/1978 | Hofmann | 89/7 |
| 4,281,582 | 8/1981 | Jaqua | 89/7 |
| 4,341,147 | 7/1982 | Mayer | 89/7 |
| 4,745,841 | 5/1988 | Magoon et al. | 89/7 |
| 4,852,458 | 8/1989 | Bulman | 89/7 |

*Primary Examiner*—Stephen C. Bentley

[57] ABSTRACT

A weapons system that fires projectiles of 20 to 500 millimeters or larger in diameter using a compression-ignition combustion of common fuel oils in conjunction with pre-compressed air as the firing force, in which automatic breech loading occurs during resetting, to enable a continuous, automatic rapid fire. Fuel pumped at a high pressure enters a combustion chamber, previously filled with high pressure air from an external compressor, where an extremely rapid combustion occurs, resulting in compression of the air in a charge chamber. A control valve then opens, allowing compressed air from the charge chamber, where high pressure fuel is then injected and instantly vaporized and combusted to propel a projectile through a barrel. A loading ram concurrently engraves the next round into a breech block chamber. In the resetting process, the valve reseats, air from an external compressor enters the combustion chamber via a check valve, and the combustion chamber is vented to the atmosphere. The breech assembly rotates to position a new projectile in the barrel so that the firing process can repeat.

1 Claim, 7 Drawing Sheets

DISTILLATE FUEL OIL/AIR-FIRED, RAPID-FIRE CANNON

This application is a division of application Ser. No. 08/210,263, filed Mar. 18, 1994, now U.S. Pat. No. 5,398, 591, which prior application is a continuation of application Ser. No. 08/006,924, filed Jan. 22, 1993, now abandoned.

BACKGROUND OF THE INVENTION

FIELD OF THE INVENTION

This invention relates to projectile firing weapons which use common engine fuels and an externally compressed air supply comprising a two state (liquid/gas) propellant system, where liquid fuel is initially ignited in one volume which causes a separate air-volume to compress, allowing extremely rapid combustion when another liquid fuel injection occurs in this second volume, further resulting in rapid expansion to fire the projectile.

PRIOR ART

The classic method of accelerating a projectile for firing is accomplished using solid chemical charges with ignition primers. Typically, either these solid charges are contained in casings and capped with the projectile, or the projectile, solid propellant charge, and the primer are individually loaded into the weapon.

The disadvantages of solid propellant systems are numerous. First, the primer, casings and charge occupy a volume at least equal to, and up to three times, that of the projectile. Thus, the space and volume requirements for the solid propellant system are limiting. Correspondingly, the weight of the solid propellant components present limitations.

Next, the lack of charge adjustability presents another limitation. The solid chemical propellants can be varied only by tedious, time-consuming methods, if this is even an option, thus removing this desirable feature from rapid-fire weapons. Similarly, combustion rates are an inherent physical property of solid propellants. Thus, adjustments to minimize muzzle flash and maximize the projectile velocity for the specific characteristics and firing conditions of the individual weapons are not readily obtainable.

Additionally, another disadvantage for solid chemical propellants is their potential hazardous effects, particularly in the combat environment. Since the solid propellants are highly combustive and/or explosive in nature, the presence of these items constitutes an extreme hazard from accidental or combat fire.

Moreover, another disadvantage for solid propellants in a combat environment is the muzzle flash and smoke upon firing. Burning fillers and uncombusted or partially combusted propellant, all typical of solid propellants systems, result in the discharge of incandescent and opaque particulate. The negative result is the significantly large, undesirable muzzle flash and smoke cloud that potentially may act as beacon to enemy troops and hinder the operator's field of vision.

Finally, solid propellant systems present disadvantages of logistics and cost.

Prior art also includes weapons which fire caseless ammunition with specially formulated liquid propellants. In applications such as described in McArthur U.S. Pat. No. 2,391, 636 and Bulman U.S. Pat. No. 4,852,458, the projectile is first accelerated mechanically or via a separate propellant system prior to acceleration by the main chemical propellants.

Other prior art, such as that disclosed in Hoffman U.S. Pat No. 4,100,836, uses an externally powered piston in conjunction with specially formulated fuels to propel the projectile. The Patent of Jaqua, U.S. Pat. No. 4,281,582, discloses a two component liquid propellant, consisting of a fuel and a reacting oxidizer, which both are simultaneously injected into the combustion chamber using a differential area injection piston. Similarly, another liquid propellant gun, Mayer U.S. Pat. No. 4,341,147, again uses differential pistons to inject liquid propellant into the combustion chamber, but it has the advantage of controlling the continuous injection rate during firing by comprising a plurality of coaxial pistons. The patent of Magoon et al., U.S. Pat. No. 4,745,841, discloses the gun using liquid propellant and a differential piston to provide regenerative injection of the propellant into the combustion chamber after an initial ignition of propellant in the combustion chamber.

The disclosure of Nelson, U.S. Pat. No. 3,380,345, shows an engine weapon in which pressurized air in conjunction with distillate fuel oils are used for firing the projectiles. This invention attempts to achieve the pressurized air charge internally. Also, the weapon is spring powered. The fuel ignition in this gun is achieved through an electrical spark. Moreover, Nelson's design has no means to power the final stage of air compression into the combustion chamber. The Nelson invention employs a split clamshell breech/loading mechanism compared to a chambered, rotating cylinder assembly.

SUMMARY OF THE INVENTION

The present invention pertains to a distillate fuel oil fired cannon. More particularly, this invention relates to a weapon system that fires projectiles of 20 to 500 millimeters or larger in diameter using a compression-ignition combustion of common fuel oils in conjunction with pre-compressed air as the firing force. Concurrent with the firing operation, automatic breech loading occurs during resetting which enables a continuous, automatic rapid fire.

The launch of each projectile occurs in a continuous, step process. The firing dynamics initially occur behind a compressor piston in a combustion chamber whereas the subsequent action occurs in the areas forward of this piston, including a charge chamber and a propulsor combustion chamber. To start the firing process, fuel pumped at a high pressure enters the combustion chamber, previously filled with high pressure air from an external compressor, where an extremely rapid combustion occurs. The resultant generation and heat expansion of the gaseous combustion products force the compressor piston forward, which correspondingly adiabatically compresses the air in the charge chamber to an extreme high pressure and temperature.

As a consequence of this pressure increase in the charge chamber, the exerted force on a control valve between the charge chamber and the propulsor combustion chamber is sufficient to overcome the opposing pressure forces, one adjustable and one inherent, and open the valve. With the control valve open, the compressed air from the charge chamber flows turbulently into the propulsor combustion chamber. High pressure fuel is then injected with precise accuracy. Since the air passing through the open control valve is at a high energy state, the added fuel is instantaneously vaporized. The high pressure air introduction coupled with this subsequent fuel combustion propels the projectile through the barrel.

Concurrent to the firing of the projectile, a loading ram comes fully forward, engraving the next round into a breech-block chamber.

A resetting process then begins. The valve reseats, and air from an external compressor enters the combustion chamber via a check valve. The combustion chamber is vented to atmosphere, allowing the exhaust gases to escape and the compressor piston to retreat to its prefiring position. The breech assembly rotates to position a new projectile in the barrel. The weapon is now in the original position and the entire firing process may repeat.

The advantages of this cannon are numerous, providing many distinct advantages over prior art. First, the energy source to fire the projectile provides various benefits over other guns. The fuel is distillate fuel oil, preferably the lighter varieties. Obviously, these fuels are not a special formulation as required in other liquid propellant guns, plus no mixing ratios are required with an oxidizer compound in the combustion chamber. In addition, these very fuels are already used on the platforms, vehicles, aircraft, and ships that would employ this invention. Thus, the fuel does not present additional problems of explosion, personnel hazard, weight and space requirements, logistics, or cost.

The firing process also provides this invention with many advantages. The projectile's acceleration is provided solely by the liquid/gas propellant system, and thus is not dependent upon any other mechanical or chemical means of acceleration. Moreover, the fuel injection process that fires the projectile may be controlled initially to be a slower burning air/fuel mixture progressing to a faster burning mixture. This controlled injection results in the projectile's increased kinetic energy compared to a single burst, a concept known as a "traveling charge," delineated by the patent of Bulman, U.S. Pat. No. 4,852,458. In addition, controlling the initial air charge from the combustion chamber, hence controlling the internally powered piston, in conjunction with the quantity/rate of fuel injection allows regulation of the acceleration and exit velocity of the projectile. As a result, this single weapon, without physical modification, may achieve various desired projectile velocities, trajectories, and ranges. Also, the second combustion that fires the projectile does not require an electric spark.

This invention also provides the distinct benefit of automatic operation. The external, instead of internal, pressurized air charge supports this rapid-fire operation. Also, the chambered, rotating, cylinder assembly which moves projectiles from the magazine into the breech block in conjunction with the firing sequence supports this continuous, automatic operation.

DESCRIPTION OF THE INVENTION

The preferred embodiment of the invention is now described with reference to the drawings, in which like numbers indicate like parts through the views.

Figure 1:
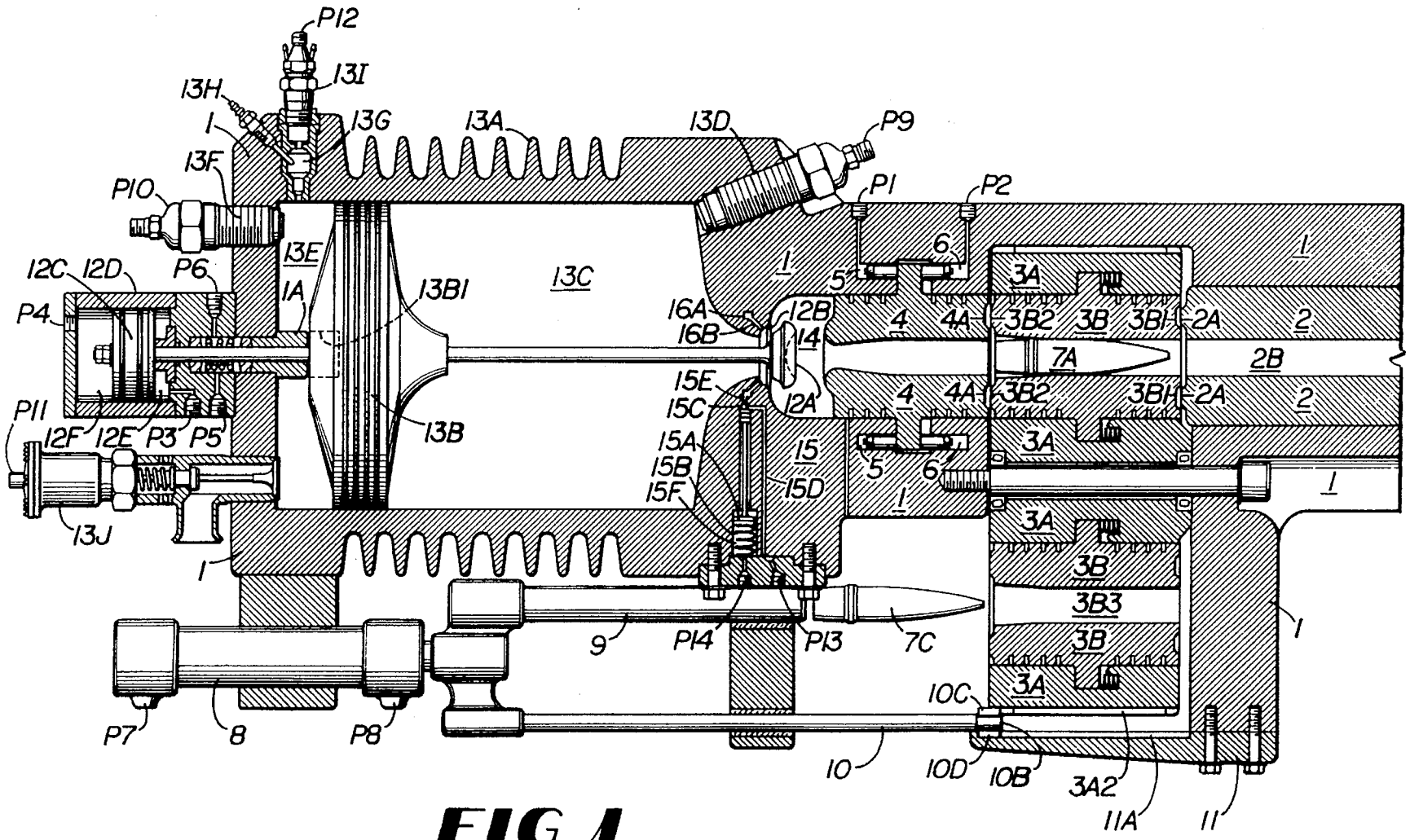
FIG. 1 is a longitudinal cross-sectional view of the distillate fuel oil/air-fired, rapid fire cannon generally showing the parts of the present invention.

A pictorial description of the stages of an entire firing sequence are shown in FIGS. 1–7. As shown in FIG. 1, the basic components include a barrel 2, rotating breech assembly 3, loading ram 9, and a compressor chamber 13, located within a housing 1. The compressor piston 13B divides the cylinder 13A into two separate volumes, namely the charge chamber 13C and the combustion chamber 13E.

The control valve assembly 12 is regulated by pneumatic or hydraulic pressure. In FIG. 1, the control valve 12A is shown in the open position. If pressure is applied through port P3 to the control chamber 12E, the control piston 12C is forced aft. Any volume in the reciprocal control chamber 12F is relieved through port P4. The resultant differential pressure acting on control piston 12C tightly closes the control valve 12A against the double valve seats 12B, as shown in FIG. 2.

Prior to starting an actual firing sequence, hot, very high pressure air (500–1500 PSI) from the final stage of an auxiliary air compressor enters the charge chamber 13C through a controller-actuated valve (not shown) attached to port P9 and a check valve 13D. Simultaneously, hot, high pressure air from the intermediate stage of the auxiliary air compressor enters the combustion chamber 13E through a controller-actuated valve (not shown) attached to port P10 and a check valve 13F. The resulting differential pressure forces the compressor piston 13B to its rearmost position, flush with the bounce pocket 13B1, as shown in FIG. 2.

Figure 2:
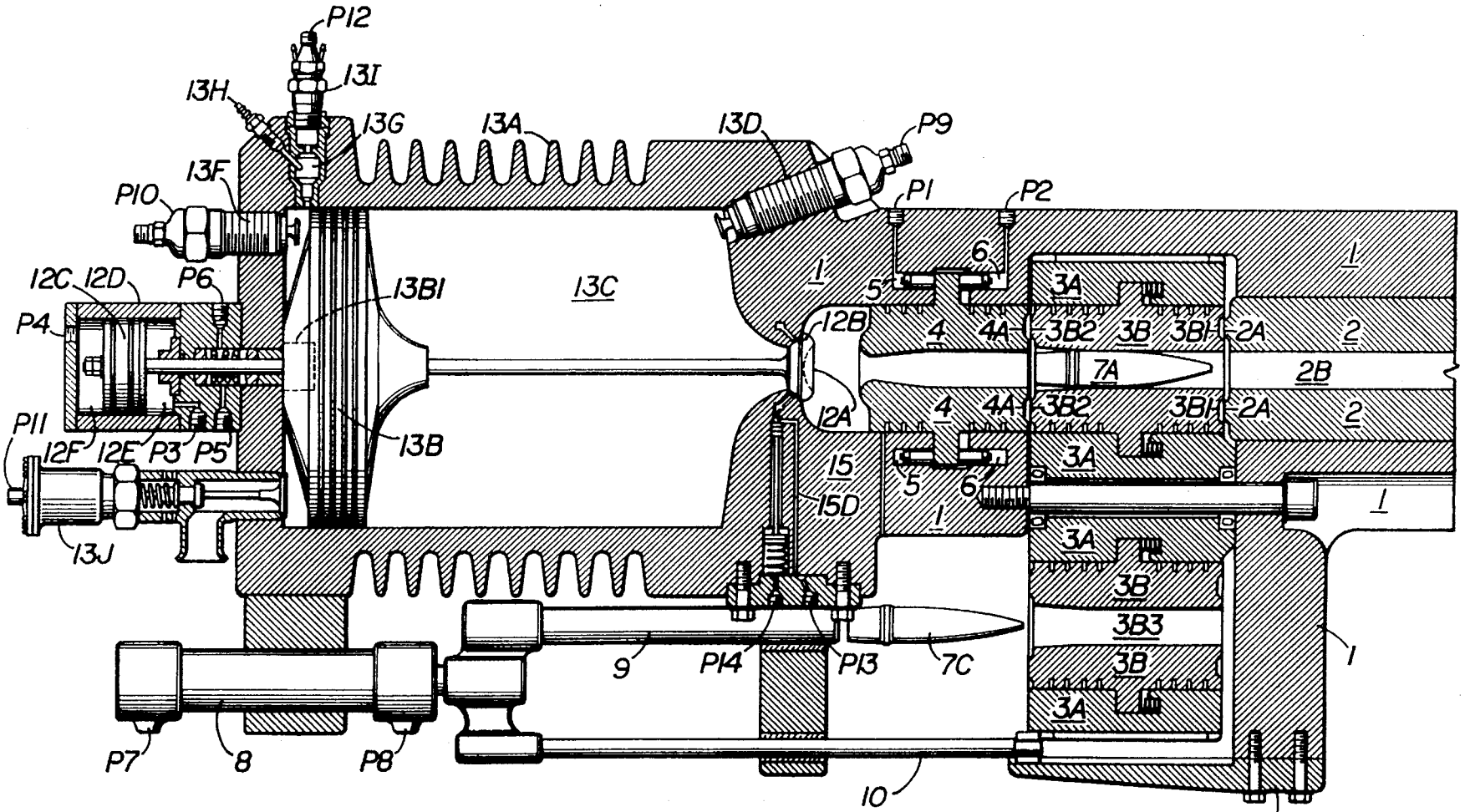
FIG. 2 is a view similar to FIG. 1 in the prefire stage of operation.

FIG. 2 also shows the loading ram 9 in the rearmost position also. Actuation pressure is applied through a controller actuated valve to P8 and pressure is relieved through port P7. This pressure forces the actuator 8 to maintain the loading ram 9 and follower assembly 10 aft. The rotating breech housing 3A is indexed so that a chamber containing a engraved (wedged) projectile 7A is aligned with the bore 2B of the barrel 2. Another breech-block chamber 3B3 is aligned coaxially with a magazine projectile 7C and the loading ram 9.

In an area forward of the control valve 12A, actuation pressure is applied, via a controller-actuated valve at port P1, to the breech actuators 5 which is relived through port P2. This pressure forces the nozzle block 4 forward to engage the breech-block 3B which in turn is forced forward to mate with the barrel 2. The engagement of the tapered tongues 2A and 3B2 and the corresponding tapered grooves 3B1 and 4A provides precise bore alignment, secure breech locking, and breech obturation. The application of this actuation pressure is illustrated by comparing the above listed components in FIG. 2 and FIG. 3.

After these preparations, the invention is ready for firing operations. As to the cannon's prefire status, the charge chamber 13C and the combustion chamber 13E are both completely and independently sealed, separated by the compressor piston 13B. The control valve 12A, both check valves 13D and 13F, and the exhaust valve 13J are all closed. The pressure differential still exists between the two chambers which maintains the piston 13B at the aft end of the compression cylinder 13A as shown in FIG. 2.

Figure 3:
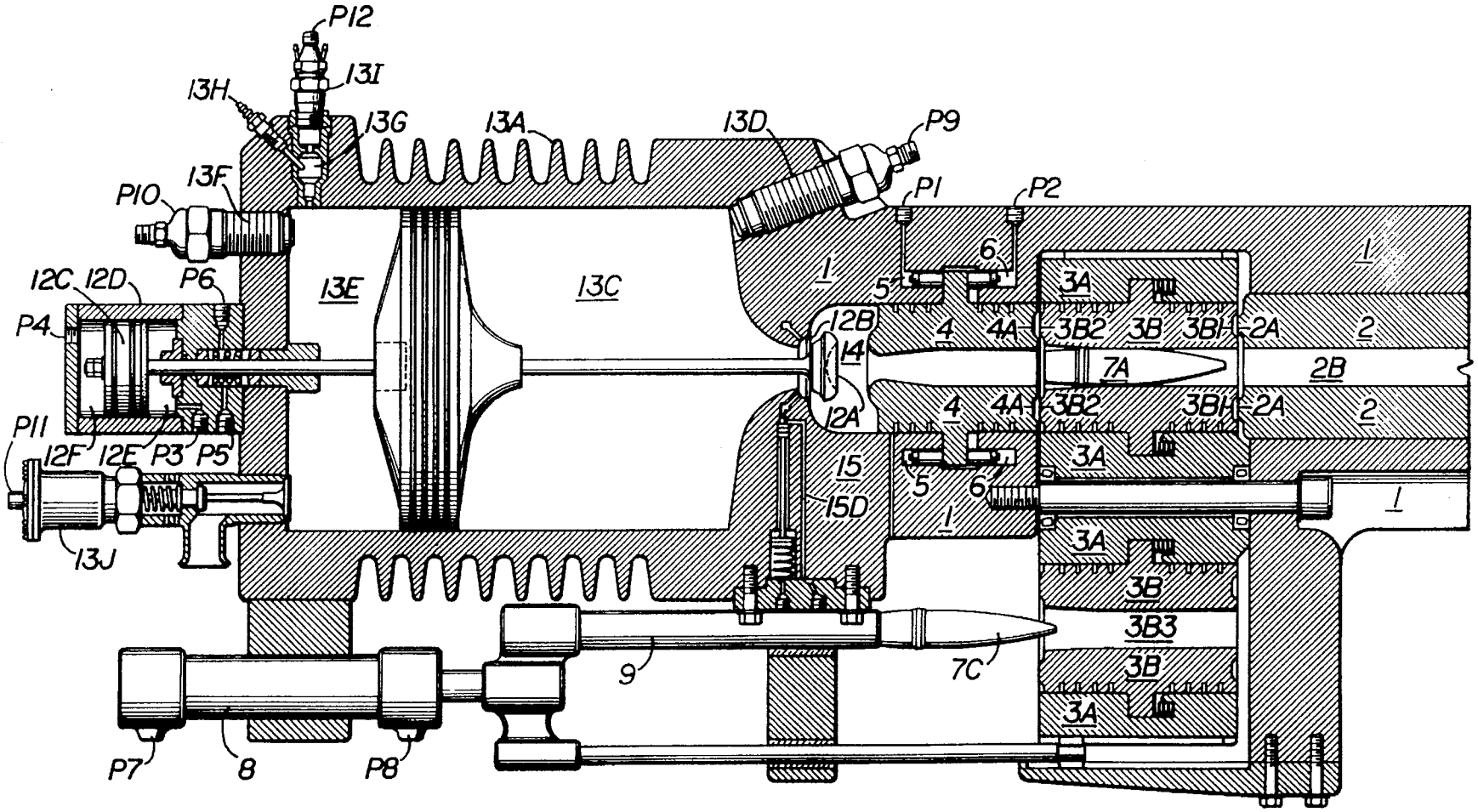
FIG. 3 is a view similar to FIG. 1 where the compressor piston has moved forward as a result of the initial firing.

To begin the actual firing procession, high pressure fuel, supplied from an auxiliary fuel injection pump, enters the pre-combustion chamber 13G through a controller-actuated valve (not shown) attached to port P12 and the fuel injection valve 13I. The fuel is atomized to improve combustion. An admixture is formed with hot, high pressure air in the pre-combustion chamber 13G. Some fuel will ignite, combust, and yield heat sufficient to vaporize, ionize and expand the balance. For "cold starts" or operations in low temperature environments, an electrically powered glow plug 13H facilitates the ignition. Additionally, an appropriate catalyst in the chamber lining, such as platinum, may be employed to aid ignition and enhance the combustion rate process. The vaporized, burning fuel mixture exits the pre-combustion chamber 13G via its nozzle as a high velocity, reactive jet. This gaseous fuel jet enters the compressor combustion chamber 13E tangentially to the compressor cylinder 13A. The fuel jet rapidly mixes and reacts with the air charge in the combustion chamber 13E, resulting in extremely rapid combustion. This combustion in the chamber 13E forces the compressor piston 13B forward, which in turn compresses the air in the charge chamber 13C. FIG. 3 shows the piston moving forward as a result of this combustion.

FIG. 3 also shows the loading ram moving forward to engage the projectile 7C (in a magazine that is not shown) occurring concurrently. To achieve the loading of the projectile, activation pressure is applied through a controller activated valve at port P7 to the loading and breech cylinder indexing actuator 8. This pressure starts the forward travel of the loading ram 9 and the connected indexing follower assembly 10. The follower assembly 10, as FIG. 1 shows, consists of the follower rod 10A, the tracking arm/bearing spindle 10B, the index groove bearing 10C, and the index guide bearing 10D. The tracking arm/bearing spindle 10B is springed from the follower rod 10A to allow displacement only in the direction of the breech cylinder 3A rotation. The index groove bearing tracks in the milled groove 3A1 (shown fully only in FIG. 7) of the exterior annular surface of the rotating breech assembly housing 3A. The index guide bearing 10D tracks in the stationary milled groove 11A of the index guide 11. FIG. 3 shows the ram having partially moved the projectile 7C out of a magazine into an indexed chamber 3B3 of a breech-block 3B.

Figure 4:
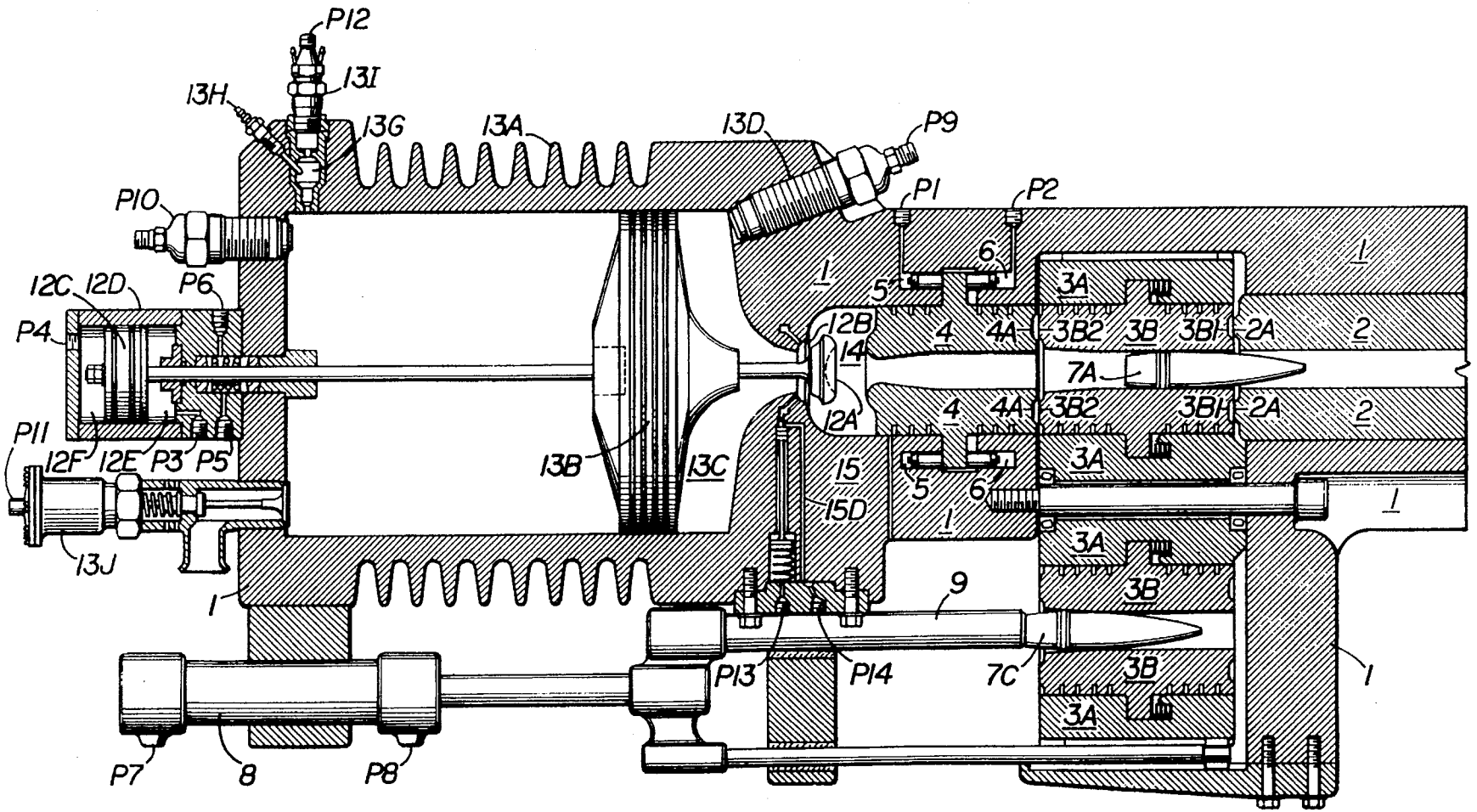
FIG. 4 is a view similar to FIG. 1 showing the compressor piston even further forward after the initial firing stage and the projectile beginning its firing transit through the barrel.

As a result of the compression piston 13B moving forward as shown in FIG. 3 and further forward as shown in FIG. 4, the charge chamber 13C volume is adiabatically compressed which yields extremely high pressure and temperature air. The pressure in the charge chamber 13C becomes sufficient to overcome the two forces maintaining the control valve 12A on its Seats 12B. These opposing forces are the existing pressure in the propulsor combustion chamber 14 and the controller valve assembly pressure set on the opposite end of the valve in the control chamber 12E. Once sufficient opening pressure exists in the compression chamber 13C, then the control valve 12A is forced from its double seats 12B. As the control valve 12A is unseated (see FIG. 4), then air from the charge chamber 13C flows through a specially shaped passage between the control valve 12A and its seats 12B into the propulsor combustion chamber 14. This specially shaped passage, or toroidal cavity, promotes extreme turbulence within this cavity, especially near the fuel distribution orifice outlets 16B. Additionally, when control valve 12A is opened, fluid displacement is sensed in the valve control chamber 12E, and the controller initiates the pressurization of the control chamber 12F to reduce the differential pressure across the control valve 12A (commensurate with the increasing propulsor combustion chamber 14 pressure) allowing it to stay open.

High pressure fuel, from an auxiliary pump, is injected into the toroidal cavity, also referred to as the mixing cavity. The flow path is from port P13, through the fuel inlet passage 15D, through the fuel outlet passage 15E, through the manifold 16A, and finally to the distribution orifices 16B located in 15° radial increments around annular periphery between the valve seats 12B. When the fuel exits the distribution orifices 16B into the mixing cavity, it is instantaneously vaporized by, and thoroughly mixed with, the hot, turbulent air transversing this cavity. The fuel injection process is controlled by regulation pressure applied at port P14 to the control chamber 15F. This control pressure in control chamber 15F acts on the top of the large piston face of the piston/pintle 15A. The piston/pintle 15A radiometrically opposes the fuel injection force of the fuel inlet passage 15D beneath the small piston face on the pintle 15A. This pressure regulation controls the distance the pintle 15A is off the pintle seat 15C thus allowing precise regulation of the fuel, flow injection rate.

The available control of the fuel flow injection rate provides this invention with many advantages. First, the injection may be controlled initially to inject a slower-burning air fuel mixture and progress to a fast-burning mixture. This can produce a "traveling charge" effect that provides the projectile more kinetic energy once it is in motion compared to a single blast prior to the projectile starting to transit forward. In addition to controlling the quantity and rate of fuel injection, the conditions of the initial air charge of the compression chamber 13C may be varied, which yields control over the acceleration and exit velocity of the projectile 7A. This fuel and combustion chamber 13C control allows the same weapon, without any physical modification, to alter the projectile's velocity, trajectory, and range and to accommodate projectiles with differing mass, configuration, and sensitivities to acceleration.

The area forward of the compression chamber 13C and aft of the projectile 7A are designed to impart increased energy during firing. The combination of the underside of the control valve 12A, the forward valve seat 12B, and the rear wall of the propulsor combustion chamber 14, form, when the control valve 12A is open, an irregular supersonic nozzle. This configuration imparts an increased velocity to the flowing mixture and, due to the irregularities, generates shock waves that enhance further fuel disassociation, that promote mixing with the air charge, and that impart additional energy to the mixture. After this high velocity combustant vapor stream exits this irregular supersonic nozzle, the stream is directed along the aft and outboard perimeter of the propulsor combustion chamber 14. The stream impacts the rear of the nozzle block 4, which further enhances the obturation of the breech train consisting of the nozzle block 4, the breech-block 3B, and the barrel 2. The entrance of the highly pressurized combustant stream causes a rapid pressure change in the propulsor combustion chamber 14 that initiates forwardmotion of the projectile 7A even before the combustion effects become significant. FIG. 4 illustrates the projectile 7A starting to accelerate forward. This irregular supersonic nozzle configuration also enhances the swirl of the combustion vapor and allows its efficient entry into the designed supersonic nozzle in the nozzle block 4.

Figure 5:
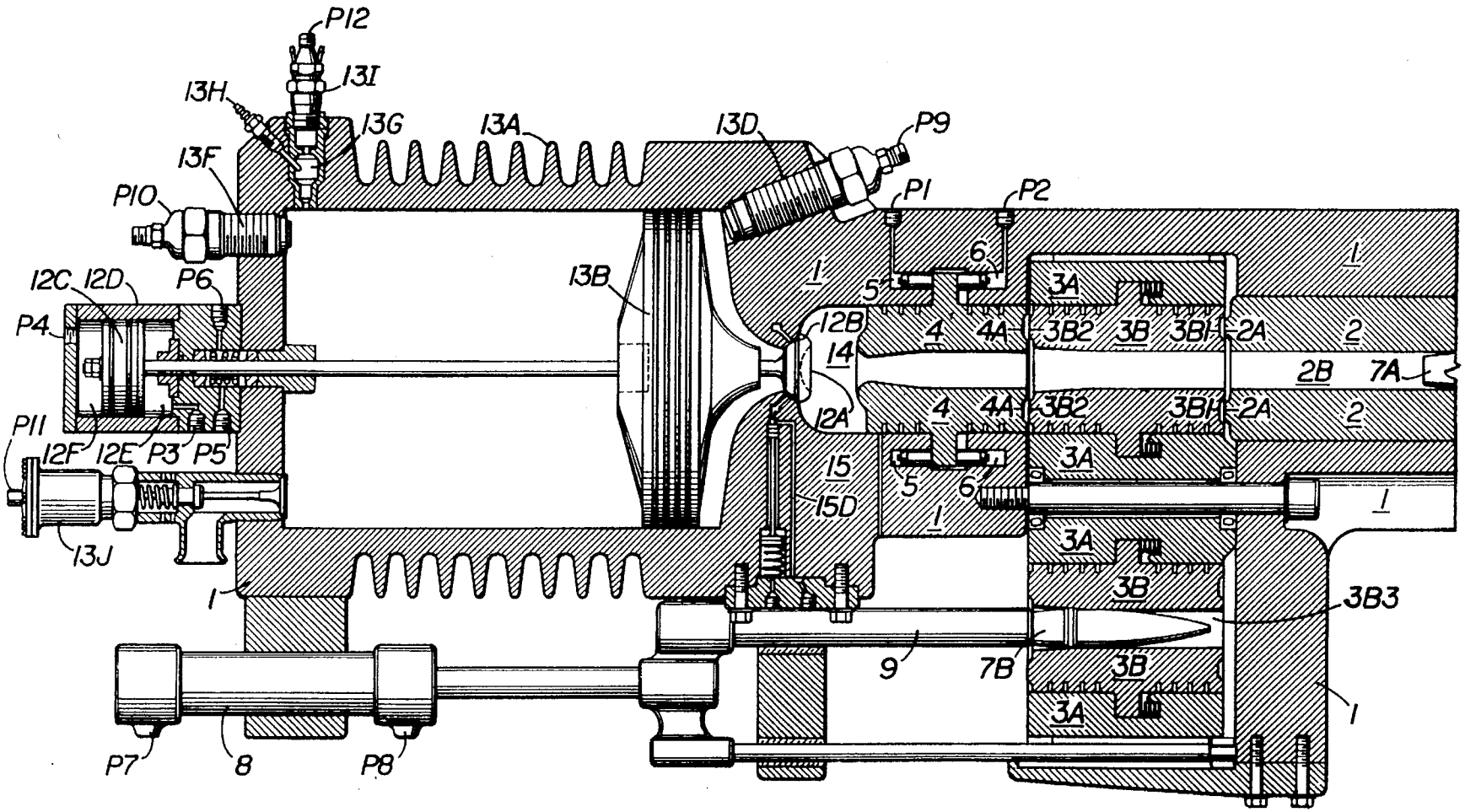
FIG. 5 is a view similar to FIG. 1 showing the compressor piston at its most forward position.

The combustants, forced into the propulsor combustion chamber 14, result in the desired combustion. The result is a sharp increase in pressure in the propulsor combustion chamber 14, which forces the control valve 12A against its seats 12B. Thus, with the shutting of control valve 12A, the compressor chamber 13C and the propulsor combustion chamber 14 are both closed volumes again. In the compressor chamber 13C, the sealing action causes the rapid deceleration of the compressor piston's 13B forward motion. On the other side of the control valve 12A, the closing causes a pressure increase which results in a proportionately larger force acting on the nozzle block 4 resulting in a further enhancement of breech obturation. Also, the pressure increase and combustion have forced the projectile 7A further down the barrel 2. These effects are illustrated in FIG. 5. FIG. 5 also shows the loading ram 9 fully forward, engraving the next round, projectile 7B into a breech-block chamber 3B3.

Figure 6:
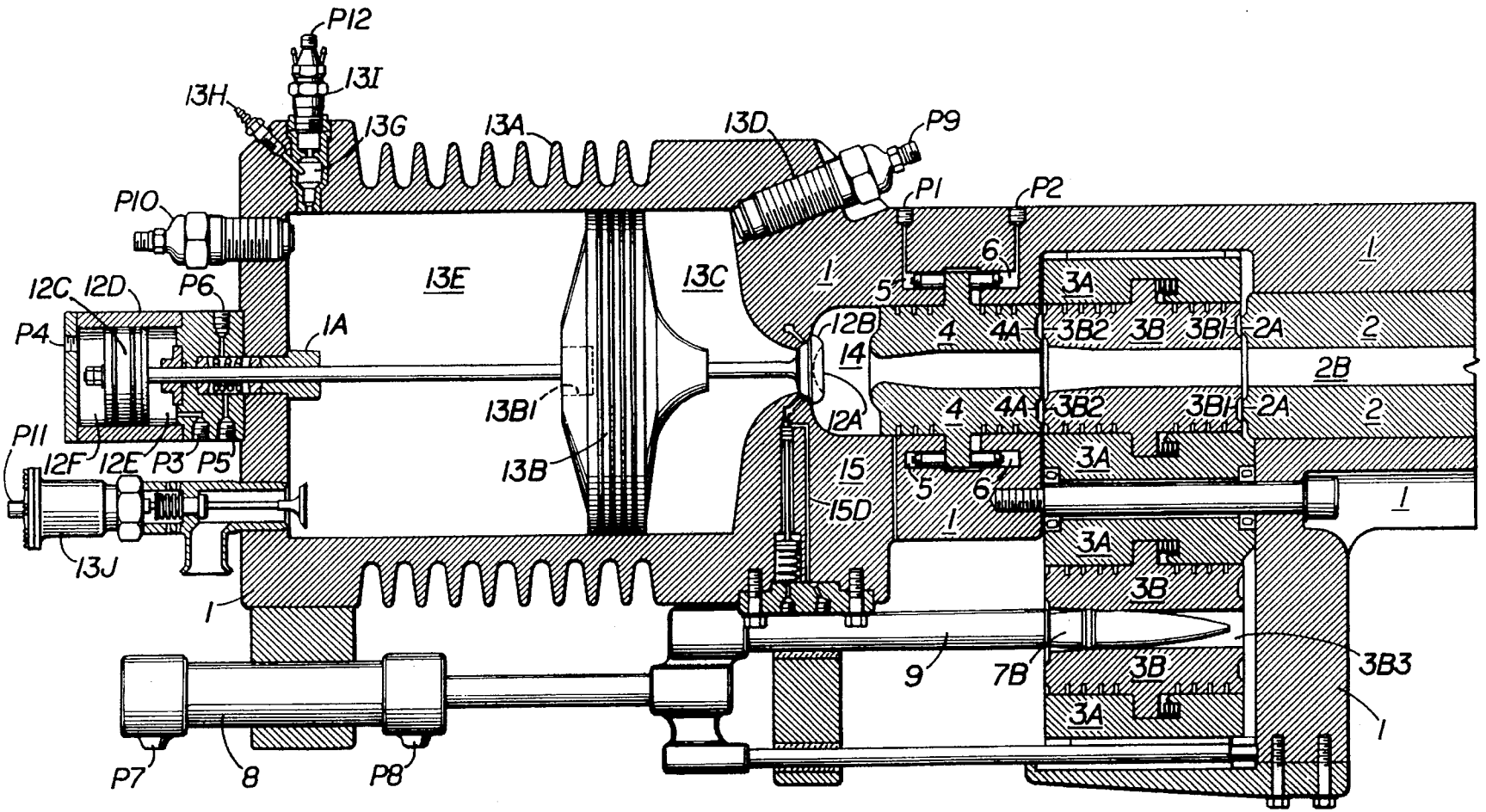
FIG. 6 is a view similar to FIG. 1 except the projectile has exited the barrel and the compressor piston is moving aft in the reset progression.

As the projectile 7A is fired from the barrel, the reset progression begins, as shown in FIG. 6. The cannon senses the end of the firing cycle by fluid displacement from the valve control chamber 12F and/or a compressor piston 13B forward position detection device. The controller then directs pressure to various areas for the resetting progression. First, the control chamber 12E is pressurized while relieving control chamber 12F to establish the opening force for the control valve 12A for subsequent firings. Next, the actuator of the exhaust valve 13J is opened, venting combustion chamber 13E to atmosphere. This venting allows the compressed gases remaining in the compression chamber 13C to expand, forcing the compression piston 13B rearward, and expelling the combustion products from the combustion chamber 13E. The compression piston's 13B motion is decelerated by trapped gases in bounce pocket 13B1 formed when it meets the control rod guide/bounce piston 1A. Additionally, the controller applies pressure to port P2, pressurizing breech disengage actuators 6, forcing the nozzle block 4 aft, which disengages the opening breech. This pressure to disengage the breech is relieved via port P1.

Once the pressure sensing devices in the compression chamber 13C sense pressure below the supply source, then the controller directs supply air into the chamber 13C via the check valve 13D. This air supply pressurizes the compression chamber 13C and ensures displacement of the compressor piston 13B to its rearmost position. Once position and pressure sensing devices sense that the compressor piston 13B is at its rearmost position and pressure in the combustion chamber 13E is below that of the supply source, then the controller directs supply air into the chamber 13E via the check valve 13F. This supply air serves to ventilate the combustion chamber 13E. After a timed interval, the controller relieves the actuation pressure from the port P11 which in turn causes the closure of exhaust valve 13J. Once the exhaust valve 13J closes, the combustion chamber 13E pressurizes. However, a differential pressure still exists relative to the compressor chamber 13C so the compressor piston 13B remains at its rearmost position.

Figure 7:
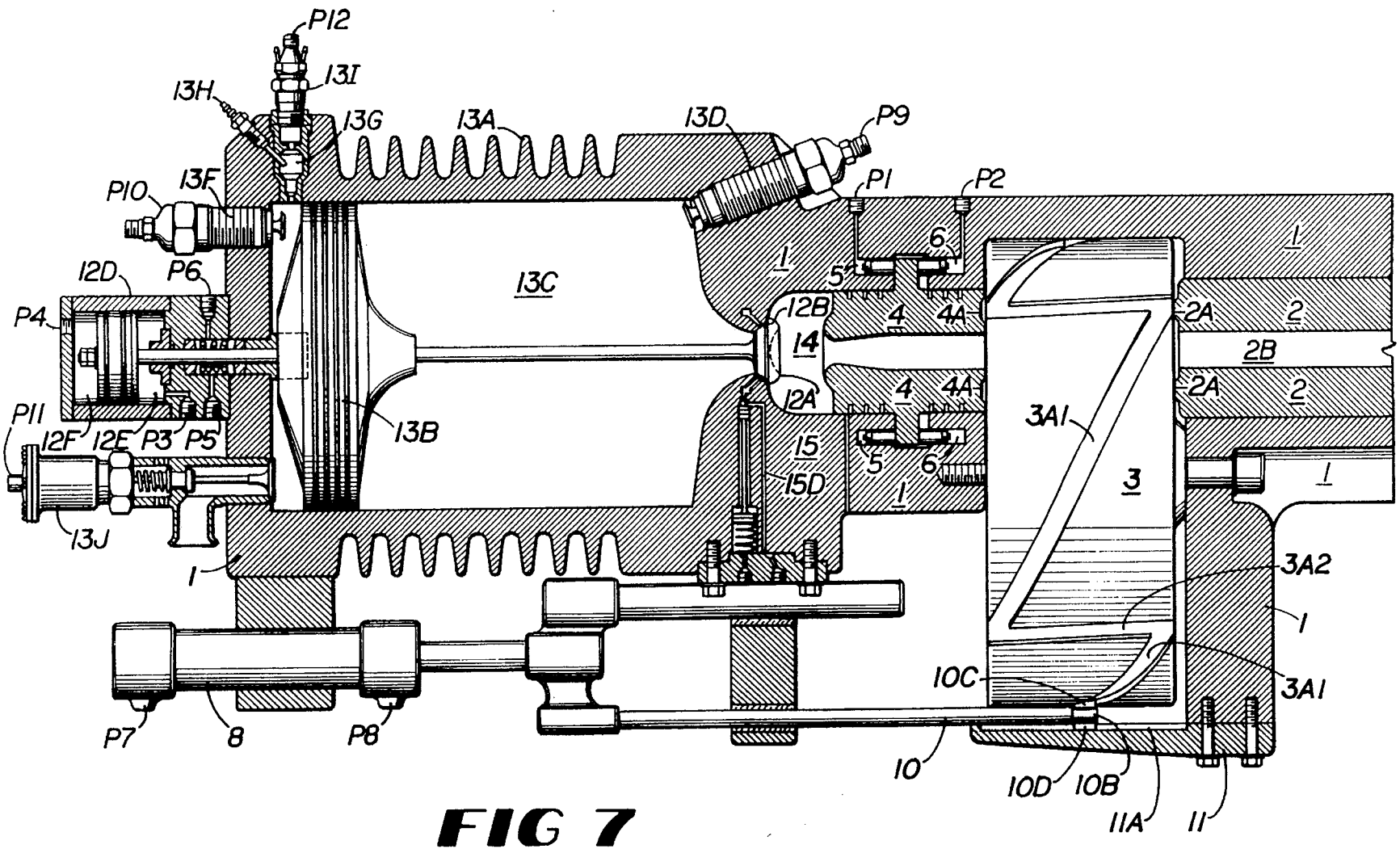
FIG. 7 is a view similar to FIG. 1, where all the firing components are in their prefire position, but showing the breech block assembly rotating to position another projectile between the nozzle block and the barrel for firing.

FIG. 7 shows the breech indexing follower assembly 10 retracted half of its stroke, with the rotating breech assembly 3 moved between chambers. During the retraction, the index guide bearing 10D tracks a fixed groove 11A in guide 11 which limits the lateral movement of springed follower assembly 10B counter to the rotation of the breech assembly 3. Simultaneously, the index groove bearing 10C tracks the angled groove 3A1 which translates the retracting force from the actuator 8 into a rotational force for the breech assembly 3. The retraction of the actuator 8 continues until a loaded chamber aligns with the barrel 2 and an empty chamber aligns with the loading ram 9 and a magazine projectile 7C, as FIG. 1 shows.

At this point, the entire operating cycle discussed above is ready to repeat. The cycles may occur continuously, thus supporting the automatic, rapid-fire operation.

What is claimed is:

1. A distillate fuel oil/air-fired cannon, comprising:

a housing forming a cylinder, a propulsor chamber forward of said cylinder and a barrel forward of said propulsor chamber;

a piston within said cylinder forming a combustion chamber aft of said piston and a charge chamber forward of said piston;

a control valve located between said charge chamber and said propulsor chamber, for sealing a passage between said charge chamber and said propulsor chamber when in the aftmost position.

piston control means attached to said control valve for applying a desired pressure to said control valve either in the forward direction or the aft direction;

means for introducing pressurized, air different pressures to said charge chamber and said combustion chamber;

means for supplying high pressure fuel for combustion in said combustion chamber to cause said piston to move forward in said cylinder and to further compress high pressure air in said charge cylinder;

means for introducing high pressure fuel into said propulsor chamber for combusting with pressurized air introduced into said propulsor chamber from said charge chamber when said control valve is open.

* * * * *